US009477181B2

(12) United States Patent
Hironaka et al.

(10) Patent No.: US 9,477,181 B2
(45) Date of Patent: Oct. 25, 2016

(54) IMAGE FORMING APPARATUS AND TRANSFER POWER SUPPLY CONTROLLING METHOD

(71) Applicant: Brother Kogyo Kabushiki Kaisha, Nagoya-shi, Aichi-ken (JP)

(72) Inventors: Keita Hironaka, Obu (JP); Yusuke Ozaki, Nagoya (JP); Hideaki Deguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 81 days.

(21) Appl. No.: 14/660,320

(22) Filed: Mar. 17, 2015

(65) Prior Publication Data

US 2015/0277300 A1 Oct. 1, 2015

(30) Foreign Application Priority Data

Mar. 31, 2014 (JP) ..... 2014-072587

(51) Int. Cl.
*G03G 15/16* (2006.01)
*G03G 15/00* (2006.01)

(52) U.S. Cl.
CPC ..... *G03G 15/1675* (2013.01); *G03G 15/80* (2013.01)

(58) Field of Classification Search
CPC ..... G03G 15/1615; G03G 15/1675
USPC ..... 399/66, 313
See application file for complete search history.

(56) References Cited

U.S. PATENT DOCUMENTS

| | | | | |
|---|---|---|---|---|
| 2003/0103785 | A1 | 6/2003 | Inukai et al. | |
| 2005/0281569 | A1 | 12/2005 | Nishimura | |
| 2009/0169230 | A1 | 7/2009 | Deguchi et al. | |
| 2013/0136466 | A1 * | 5/2013 | Saito | G03G 15/18 399/31 |

FOREIGN PATENT DOCUMENTS

| | | | |
|---|---|---|---|
| JP | H08-114989 | A | 5/1996 |
| JP | 2001-209254 | A | 8/2001 |
| JP | 2002-202671 | A | 7/2002 |
| JP | 2004-101967 | A | 4/2004 |
| JP | 2006-003538 | A | 1/2006 |
| JP | 2009-157231 | A | 7/2009 |

* cited by examiner

*Primary Examiner* — Robert Beatty
(74) *Attorney, Agent, or Firm* — Banner & Witcoff, Ltd.

(57) ABSTRACT

An image forming apparatus including an image carrier, a transfer member, an application circuit and a controller configured to acquire a transfer resistance value, the transfer resistance value being a value of electric resistance between the image carrier and the transfer member, determine whether the acquired transfer resistance value is less than or equal to a reference resistance value, and control the application circuit, in response to determining that the acquired transfer resistance value is less than or equal to the reference resistance value, to perform a current control process to cause a value of a transfer current passing through the transfer member becomes a target current value.

20 Claims, 7 Drawing Sheets

IMAGE FORMING APPARATUS AND TRANSFER POWER SUPPLY CONTROLLING METHOD

CROSS-REFERENCE TO RELATED APPLICATION

This application claims priority from Japanese Patent Application No. 2014-072587 filed on Mar. 31, 2014, the content of which is incorporated herein by reference in its entirety.

FIELD OF DISCLOSURE

The disclosure relates to a technique of controlling power supply to a transfer member of an image forming apparatus.

BACKGROUND

A known image forming apparatus includes an image carrier and a transfer member. The image forming apparatus is configured to transfer a toner image on the image carrier onto a sheet that passes between the image carrier and the transfer member, by controlling power supply to the transfer member. To prevent or reduce poor transfer, the image forming apparatus is configured to switch a power supply control to the transfer member from a constant current control to a constant voltage control, and vice versa, when a resistance value of the transfer member exceeds a reference limiting value.

SUMMARY

However, poor transfer might not be prevented or reduced by switching between the constant current control and the constant voltage control with reference to just one reference limiting value, as in the known image forming apparatus.

According to illustrative aspects of the present disclosure, an image forming apparatus is provided that includes an image carrier, a transfer member, an application circuit, and a controller configured to acquire a transfer resistance value, the transfer resistance value being a value of electric resistance between the image carrier and the transfer member, determine whether the acquired transfer resistance value is less than or equal to a first reference resistance value, control the application circuit, in response to determining that the acquired transfer resistance value is less than or equal to the first reference resistance value, to perform a first current control process to cause a value of a transfer current passing through the transfer member becomes a first target current value, determine, in response to determining that the acquired transfer resistance value is not less than or equal to the first reference resistance value, whether the acquired transfer resistance value is less than or equal to a second reference resistance value, the second reference resistance value being greater than the first reference resistance value, control the application circuit, in response to determining that the acquired transfer resistance value is less than or equal to the second reference resistance value, to perform a voltage control process to cause a value of a transfer voltage applied to the transfer member to become a target voltage value, and control the application circuit, in response to determining that the acquired transfer resistance value is not less than or equal to the second reference resistance value, to perform a second current control process to cause a value of the transfer current to become a second target current value, an absolute value of the second target current value being smaller than an absolute value of the first target current value.

According to aspects of the present disclosure, further provided is a power supply controlling method comprising the steps of acquiring a transfer resistance value, the transfer resistance value being a value of electric resistance between an image carrier of an image forming apparatus and a transfer member of the image forming apparatus, determining whether the acquired transfer resistance value is less than or equal to a first reference resistance value, controlling an application circuit of the image forming apparatus, in response to determining that the acquired transfer resistance value is less than or equal to the first reference resistance value, to perform a first current control process to cause a value of a transfer current passing through the transfer member to become a first target current value, determining, in response to determining that the acquired transfer resistance value is not less than or equal to the first reference resistance value, whether the acquired transfer resistance value is less than or equal to a second reference resistance value, the second reference resistance value being greater than the first reference resistance value, controlling the application circuit, in response to determining that the acquired transfer resistance value is less than or equal to the second reference resistance value, to perform a voltage control process to cause a value of a transfer voltage applied to the transfer member to become a target voltage value, and controlling the application circuit, in response to determining that the acquired transfer resistance value is not less than or equal to the second reference resistance value, to perform a second current control process to cause a value of the transfer current to become a second target current value, an absolute value of the second target current value being smaller than an absolute value of the first target current value.

According to aspects of the present disclosure, further provided is a non-transitory computer-readable medium storing computer-readable instructions, that when executed by a controller, cause the controller to perform acquiring a transfer resistance value, the transfer resistance value being a value of electric resistance between an image carrier of the image forming apparatus and a transfer member of the image forming apparatus, determining whether the acquired transfer resistance value is less than or equal to a first reference resistance value, controlling an application circuit of an image forming apparatus, in response to determining that the acquired transfer resistance value is less than or equal to the first reference resistance value, to perform a first current control process to cause a value of a transfer current passing through the transfer member to become a first target current value, determining, in response to determining that the acquired transfer resistance value is not less than or equal to the first reference resistance value, whether the acquired transfer resistance value is less than or equal to a second reference resistance value, the second reference resistance value being greater than the first reference resistance value, controlling the application circuit, in response to determining that the acquired transfer resistance value is less than or equal to the second reference resistance value, to perform a voltage control process to cause a value of a transfer voltage applied to the transfer member to become a target voltage value, and controlling the application circuit, in response to determining that the acquired transfer resistance value is not less than or equal to the second reference resistance value, to perform a second current control process to cause a value of the transfer current to become a second target current value, an absolute value of the second target current value being smaller than an absolute value of the first target current value.

DETAILED DESCRIPTION

Figure 1:
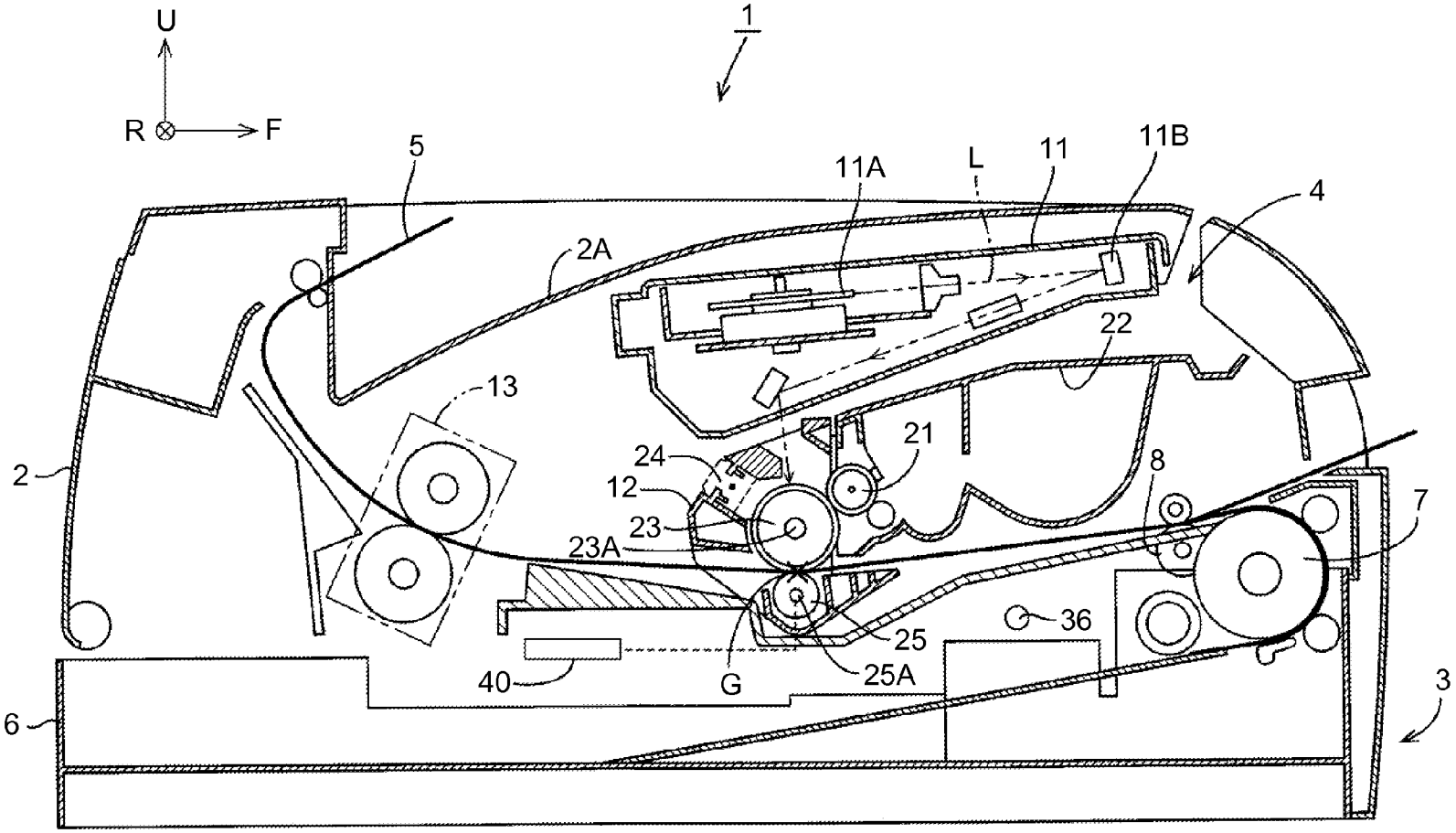
FIG. 1 is a diagram of an internal structure of a printer in an illustrative embodiment according to one or more aspects of the disclosure.

A printer 1 according to an illustrative embodiment will be described with reference to FIGS. 1-7. The printer 1 may be monochrome laser printer. The printer 1 is an example of an image forming apparatus. In the following description, the right side of the sheet of FIG. 1 is defined as the front/forward (F) side of the printer 1. The back side of the sheet of FIG. 1 is defined as the right (R) side of the printer 1. The upper side of the sheet of FIG. 1 is defined as the upper (U) side of the printer 1.

As depicted in FIG. 1, the printer 1 includes a feeder unit 3 and an image forming unit 4 that are disposed in a main casing 2.

The feeder unit 3 is an example of a sheet feeder. The feeder unit 3 is configured to feed a sheet 5 to a transfer position G where the image forming unit 4 forms an image. More specifically, the feeder unit 3 includes a sheet tray 6, a pickup roller 7 and a registration roller 8. The sheet tray 6 is configured to accommodate a plurality of sheets 5. The pickup roller 7 is configured to feed the sheets 5 one by one from the sheet tray 6. The registration roller 8 is configured to feed the sheet 5 fed by the pickup roller 7, to the transfer position G after skew of the sheet 5 is corrected.

The image forming unit 4 is configured to form an image on the sheet 5 fed by the feeder unit 3. More specifically, the image forming unit 4 includes a scanner unit 11, a process unit 12, and a fixing unit 13. The scanner unit 11 is configured to irradiate a surface of a photosensitive drum 23 (described below) with a laser beam L emitted from a laser light source (not depicted) via a polygon mirror 11A and a reflecting mirror 11B. Thus, the surface of the photosensitive drum 23 is exposed to the laser beam L.

The process unit 12 includes a developing roller 21, a toner chamber 22, a photosensitive drum 23, a charger 24 and a transfer roller 25. The transfer position G is a position at which the photosensitive drum 23 and the transfer roller 25 oppose each other. The photosensitive drum 23 is an example of an image carrier. A drum shaft 23A of the photosensitive drum 23 is grounded. The charger 24 is configured to uniformly and positively charge the surface of the photosensitive drum 23. The charged surface of the photosensitive drum 23 is exposed to the laser beam L from the scanner unit 11, to form an electrostatic latent image based on image data. The developing roller 21 is configured to supply positive-polarity toner accommodated in the toner chamber 22 to the electrostatic latent image. The electrostatic latent image is developed into a toner image.

The transfer roller 25 is an example of a transfer member. The transfer roller 25 includes a metal roller shaft 25A, that is covered by a roller portion formed of, for example, conductive rubber material. As an application circuit 40 applies a transfer voltage V to the roller shaft 25A, the toner image on the photosensitive drum 23 is transferred to the sheet 5 passing through the transfer position G.

The fixing unit 13 is configured to thermally fix the toner transferred to the sheet 5. After the toner is thermally fixed, the sheet 5 is discharged onto a discharge tray 2A.

Figure 2:
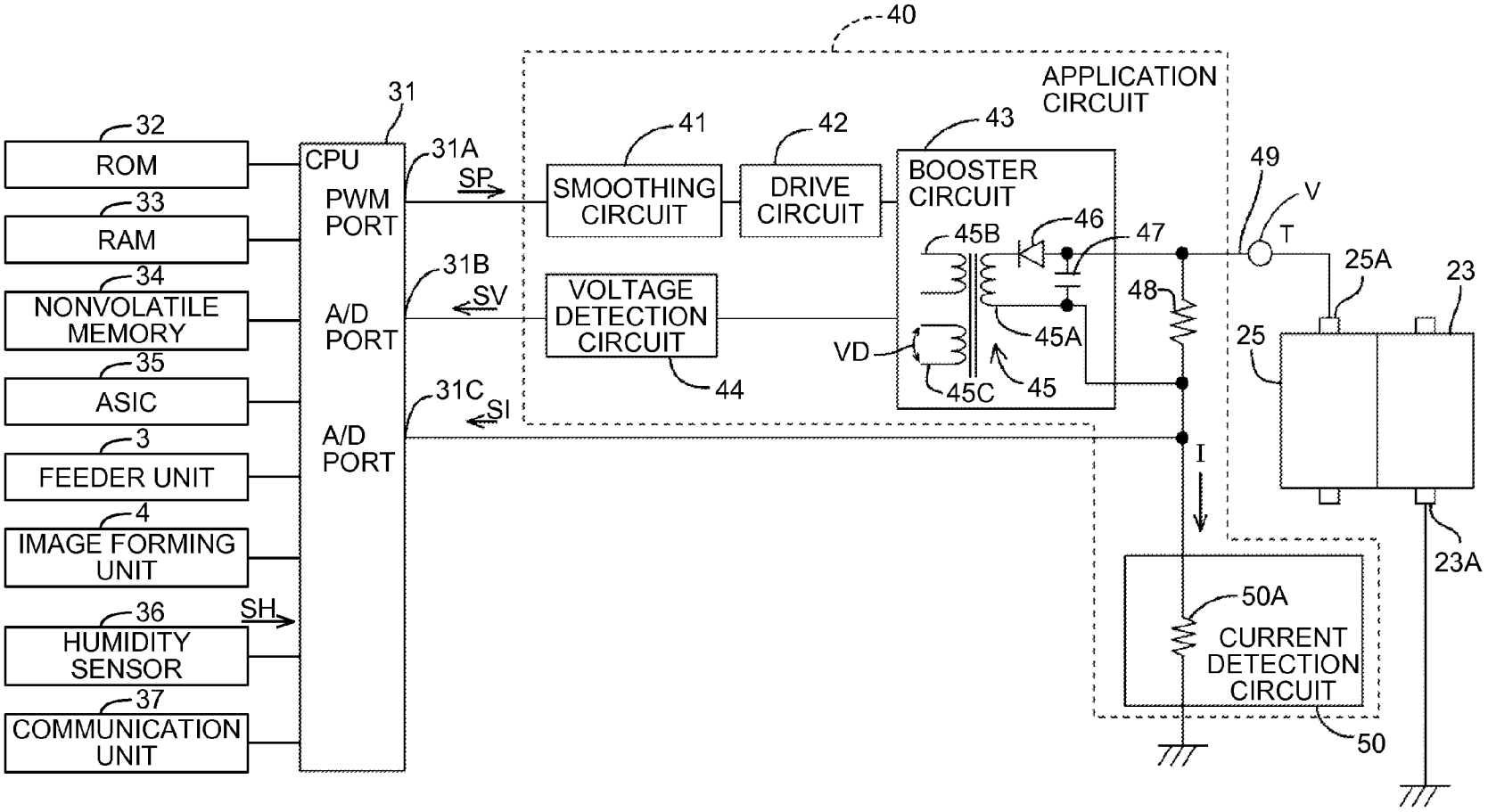
FIG. 2 is a block diagram depicting an electrical configuration of the printer.

As depicted in FIG. 2, the printer 1 further includes a central processing unit ("CPU") 31, a read only memory ("ROM") 32, a random-access memory ("RAM") 33, a nonvolatile memory 34, an application specific integrated circuit ("ASIC") 35, a humidity sensor 36, a communication unit 37, and an application circuit 40, in addition to the feeder unit 3 and the image forming unit 4.

The ROM 32 stores therein various programs. The various programs include, for example, programs for performing control processing (described below) and programs for controlling operations of components of the printer 1. The RAM 33 is used as a work area when the CPU 31 performs various programs, and a storage area to temporarily store data. The nonvolatile memory 34 may be a rewritable memory, e.g., a nonvolatile RAM ("NVRAM"), a flush memory, a hard disk drive ("HDD"), and an electrically erasable programmable read only memory ("EEPROM").

The CPU 31 is an example of a controller. The CPU 31 is configured to control components of the printer 1 in accordance with programs read from the ROM 32. The ASIC 35 is hardware circuitry dedicated to image processing. The humidity sensor 36 is disposed in the main casing 2. The humidity sensor 36 is configured to output a detection signal SH according to the humidity in the main casing 2. The CPU 31 is configured to detect the humidity in the image forming unit 4 or the sheet tray 6 based on the detection signal SH. The communication unit 37 is an interface to perform communication with an external device in a wired or wireless communication method.

The application circuit 40 is an example of an application portion. The application circuit 40 is configured to apply a negative-polarity transfer voltage V to the roller shaft 25A of the transfer roller 25 for power supply. The CPU 31 performs a pulse width modulation ("PWM") control for the application circuit 40 to control power supply to the transfer roller 25. More specifically, the application circuit 40 includes a smoothing circuit 41, a drive circuit 42, a booster circuit 43, a voltage detection circuit 44 and a current detection circuit 50.

The smoothing circuit 41 is configured to smooth a PWM signal SP from a PWM port 31A of the CPU 31. The drive circuit 42 is configured to flow an oscillating current to a primary winding 45B of the booster circuit 43 based on the smoothed PWM signal SP.

The booster circuit 43 includes a transformer 45, a diode 46, and a smoothing capacitor 47. The transformer 45 includes a secondary winding 45A, a primary winding 45B and an auxiliary winding 45C. An end of the secondary winding 45A is connected to a connection line 49 via the diode 46. The other end of the secondary winding 45A is connected to the current detection circuit 50. The smoothing capacitor 47 and a resistor 48 are connected in parallel to the secondary winding 45A.

In such a structure, the booster circuit 43 is configured to boost and rectify a voltage of the primary winding 45B and apply the rectified voltage to the roller shaft 25A of the transfer roller 25 connected to an output terminal T of the application circuit 40, as a transfer voltage V.

The voltage detection circuit 44 is configured to output a detection signal SV according to an output voltage VD in the auxiliary winding 45C, to an A/D port 31B of the CPU 31. The CPU 31 is configured to detect an output value of the transfer voltage V based on the detection signal SV. The current detection circuit 50 includes a detection resistor 50A connected, for example, between the resistor 48 and ground. The current detection circuit 50 is configured to output a detection signal SI according to a value of a transfer current I passing through the connection line 49, to an A/D port 31C of the CPU 31. The application circuit 40 includes circuitry (not depicted) for generating other high voltages, e.g., a charge voltage.

The CPU 31 is configured to control the application circuit 40 to perform a constant voltage control such that an output value of the transfer voltage V becomes a target voltage value, based on the detection signal SV from the voltage detection circuit 44. The CPU 31 is configured to control the application circuit 40 to perform a constant current control such that a value of the transfer current I becomes a target current value, based on the detection signal SI from the current detection circuit 50.

Next, characteristic lines of transfer resistance values and proper values of the transfer current I (e.g., proper transfer current values) will be described. Electric resistances of the photosensitive drum 23, the transfer roller 25, and the sheet 5 passing the transfer position G may fluctuate according to an ambient environment, e.g., humidity and temperatures in and outside the main casing 2, tolerances of electric resistances of the photosensitive drum 23 and the transfer roller 25, and deterioration of the photosensitive drum 23 and the transfer roller 25. Therefore, appropriate power supply needs to be provided to the transfer roller 25 according to the changes in the ambient environment. For example, insufficient power supply causes insufficient adhesion force of toner on the sheet 5, so that the toner remains on the photosensitive drum 23 after the toner image has been transferred to the sheet 5 from the surface of the photosensitive drum 23. The residual toner may be transferred to another or an unintended portion of the sheet 5. Conversely, excessive power supply may cause toner splashes or damages on the photosensitive drum 23 due to electric discharge.

Figure 3:
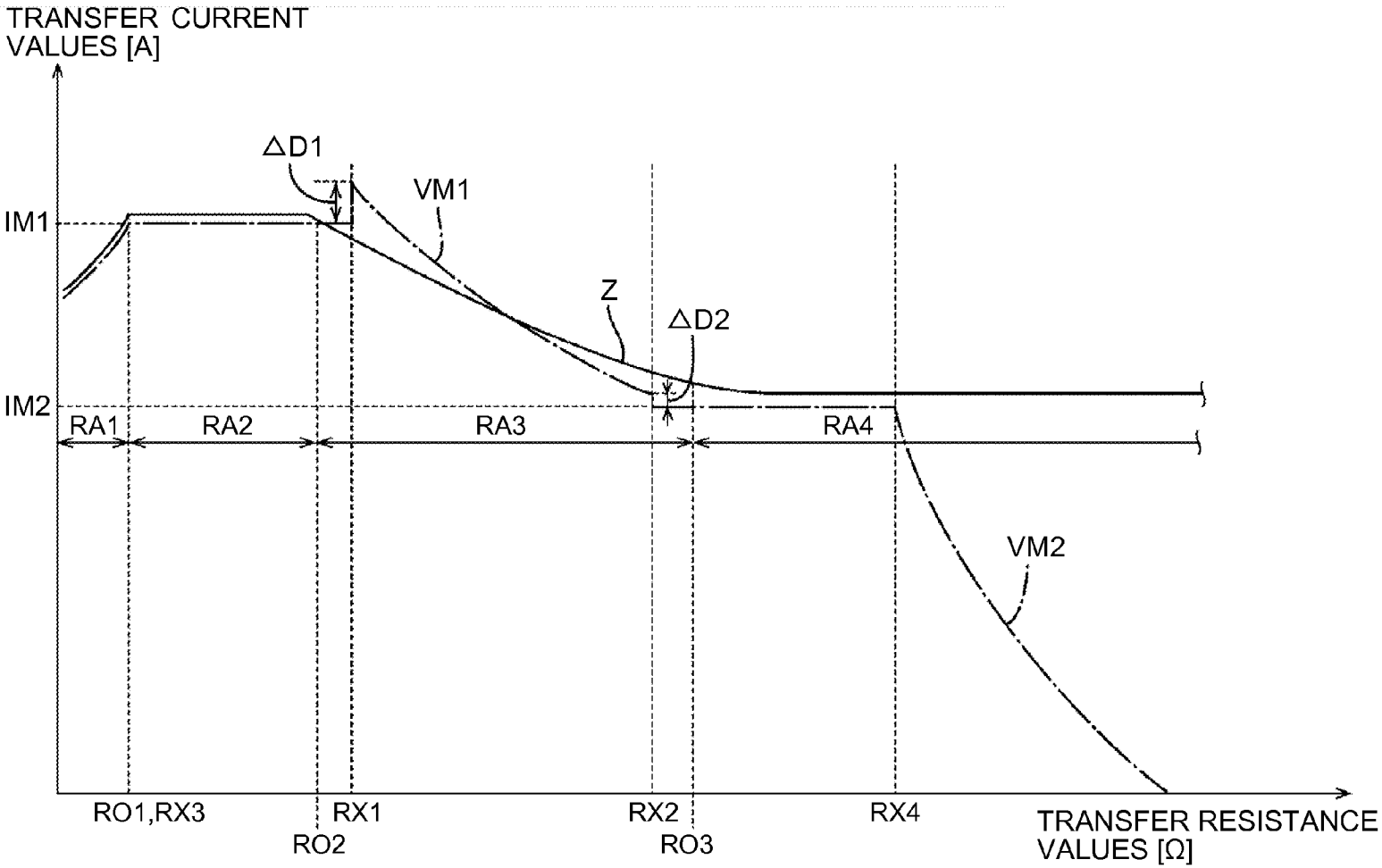
FIG. 3 is a graph depicting characteristics of changes in transfer resistance values and proper transfer current values.

In FIG. 3, a characteristic line Z representing correlation between transfer resistance values and proper values of the transfer current I is shown in solid line. The transfer resistance value is a value of electric resistance between the photosensitive drum 23 and the transfer roller 25, more specifically, electric resistance of a current path from the photosensitive drum 23 to the transfer roller 25 and a transfer system including the transfer roller 25. Proper transfer current values are values of the transfer current I that do not cause a poor transfer, as described above, in respective transfer resistance values. In FIG. 3, proper transfer current values are shown in absolute values. The characteristic line Z may be obtained, for example, by experiment.

In FIG. 3, the characteristic is divided into four resistance ranges RA1, RA2, RA3, and RA4 by three transfer resistance values RO1-RO3. The resistance range RA1 is a range of transfer resistance values less than the transfer resistance value RO1. As the transfer resistance values become greater in the resistance range RA1, absolute values of the proper transfer current values become greater. Under high-temperature and high-humidity conditions, a transfer resistance value is likely to fall into the resistance range RA1. The resistance range RA2 is a range of transfer resistance values greater than the transfer resistance value RO1 and less than or equal to the transfer resistance value RO2. Even as the transfer resistance values become greater in the resistance range RA2, absolute values of the proper transfer current values are almost the same. Under high-temperature and low-humidity conditions, a transfer resistance value is likely to fall into the resistance range RA2.

The resistance range RA3 is a range of transfer resistance values greater than the transfer resistance value RO2 and less than or equal to the transfer resistance value RO3. As the transfer resistance values become greater in the resistance range RA3, absolute values of the proper transfer current values become smaller. The resistance range RA4 is a range of transfer resistance values greater than the transfer resistance value RO3. Even as the transfer resistance values become greater in the resistance range RA4, absolute values of the proper transfer current values are almost the same. Under low-temperature and low-humidity conditions, a transfer resistance value is likely to fall into the resistance range RA4. As described above, a rate of change of a proper transfer current value relative to a transfer resistance value is relatively high in the resistance ranges RA1 and RA3. The rate of change is relatively low in the resistance ranges RA2 and RA4.

The CPU 31 is configured to control power supply to the transfer roller 25, by switching between constant current control and constant voltage control according to the transfer resistance values, such that the correlation between a transfer resistance value and a value of the transfer current I approaches or is brought closer to the characteristic line Z, as will be described later. More specifically, the constant current control may be performed when a transfer resistance value exceeds a third reference resistance value RX3 and is less than or equal to a first reference resistance value RX1. The constant voltage control may be performed when a transfer resistance value exceeds the first reference resistance value RX1 and is less than or equal to a second reference resistance value RX2. The constant current control may be performed when a transfer resistance value exceeds the second reference resistance value RX2 and is less than a fourth reference resistance value RX4.

Controls to be performed by the CPU 31 will be described referring to FIGS. 3-7. When the CPU 31 determines that, for example, the communication unit 37 has received a print job, the CPU 31 performs control processing depicted in FIG. 4. The print job includes image data to be printed, sheet information, e.g., a sheet type and a sheet size, and print requirements, e.g., designation of high-speed printing. The CPU 31 controls the feeder unit 3 to start feeding one sheet 5 in S1 of FIG. 4. More specifically, the CPU 31 starts up the feeder unit 3, to make the pickup roller 7 feed out one sheet 5 from the sheet tray 6.

Figure 5:
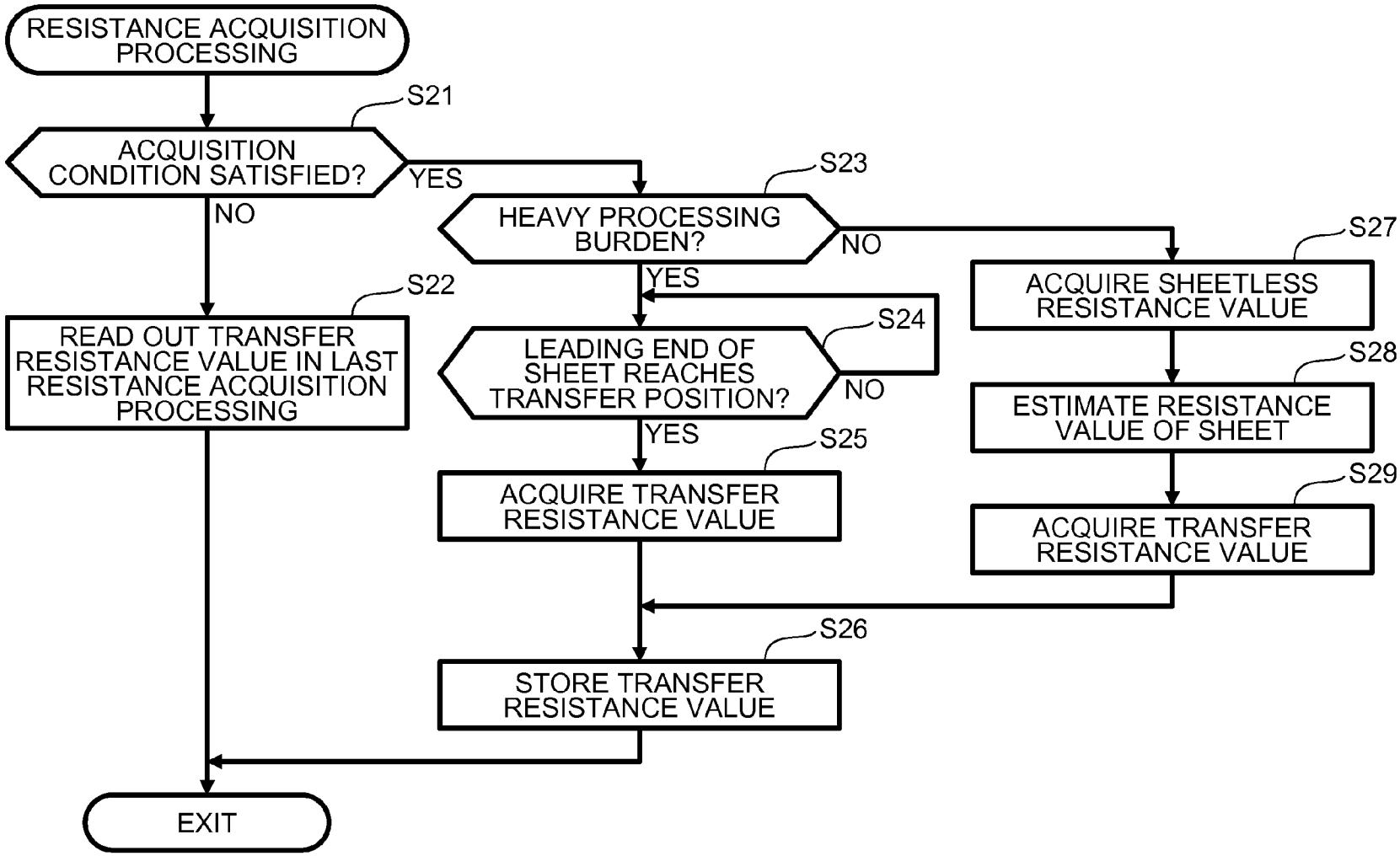
FIG. 5 is a flowchart depicting resistance acquisition processing.

In S2, the CPU 31 performs resistance acquisition processing depicted in FIG. 5. The step S2 is an example of a resistance acquisition process. In the resistance acquisition processing, a transfer resistance value when an operation of transferring the toner image to the sheet 5 by the transfer roller 25 is performed, e.g., when the sheet 5 exists at the transfer position G, is acquired. In S21 of FIG. 5, the CPU 31 determines whether an acquisition condition is satisfied. The acquisition condition is a condition to acquire a transfer resistance value for a current transfer-subject sheet 5 that is currently subjected to a transfer operation. For example, the acquisition condition is such a condition that the time elapsed from a transfer operation to a previous, e.g., the last, sheet 5 is greater than or equal to a reference time, or at least one of the sheet type and the sheet size is different between the last sheet 5 that is lastly subjected to a transfer operation and the current transfer-subject sheet 5.

In accordance with the determination of the CPU 31 that acquisition condition is not satisfied (S21: NO), the CPU 31 reads out a transfer resistance value at the time of performing the last resistance acquisition processing, for example, from the nonvolatile memory 34. The CPU 31 determines the read transfer resistance value as a transfer resistance value for the current processing (S22) and proceeds to S3 of FIG. 4. Accordingly, for example, even when processing burden on the CPU 31 is heavy as the time elapsed from a transfer operation to the last sheet 5 is short, delay in the start of, for example, a control determination processing (described below), from the resistance acquisition processing, due to delay in processing of the CPU 31, may be prevented or reduced because a transfer resistance value is not newly acquired for the current processing.

In accordance with the determination of the CPU 31 that acquisition condition is satisfied (S21: YES), the CPU 31 determines whether processing burden on the CPU 31 in a transfer operation to the current sheet 5 is heavy (S23). The CPU 31 determines that processing burden is heavy, for example, when an amount of image data to be transferred to the current sheet 5 is greater than or equal to a predetermined amount, a high-speed printing is designated, or a printing resolution is greater than or equal to a predetermined value.

In accordance with the determination of the CPU 31 that processing burden is heavy (S23: YES), the CPU 31 acquires a transfer resistance value when a leading end of the sheet 5 reaches the transfer position G. More specifically, the CPU 31 determines whether the leading end of the current sheet 5 to which an image is to be transferred reaches the transfer position G, for example, based on a period of time that has elapsed since the pickup roller 7 feeds the sheet 5 or a period of time that has elapsed since a sensor (not depicted) detects the sheet 5 (S24). When the CPU 31 determines that the leading end of the sheet 5 does not reach the transfer position G (S24: NO), the CPU 31 waits. In accordance with the determination of the CPU 31 that the leading end of the sheet 5 reaches the transfer position G (S24: YES), the CPU 31 acquires a transfer resistance value when the leading end of the sheet 5 reaches the transfer position G (S25).

More specifically, the CPU 31 controls the application circuit 40 to supply power to the transfer roller 25 for a predetermined time, for example, when the leading end of the sheet 5 reaches the transfer position G. The CPU 31 acquires values of the transfer voltage V and the transfer current I when the leading end of the sheet 5 reaches the transfer position G, based on the detection signal SV from the voltage detection circuit 44 and the detection signal SI from the current detection circuit 50 when the power is supplied to the transfer roller 25. The CPU 31 calculates a transfer resistance value by dividing the value of the transfer voltage V by the value of the transfer current I. After the CPU 31 acquires the transfer resistance value, the CPU 31 stores the transfer resistance value, for example, in the RAM 33 (S26). The CPU 31 proceeds to S3 of FIG. 4. Therefore, as compared with a case in which a transfer resistance value is acquired after the leading end of the sheet 5 passes the transfer position G, power supply to the transfer roller 25 may be performed in a control method determined based on a transfer resistance value corresponding to a resistance value of the current sheet 5. Therefore, occurrence of poor transfer in an entire sheet 5 may be prevented or reduced.

In accordance with the determination of the CPU 31 that processing burden on the CPU 31 is not heavy (S23: NO), the CPU 31 acquires a sheetless resistance value (S27). The sheetless resistance value is an electric resistance between the transfer roller 25 and the photosensitive drum 23 when the sheet 5 is not at the transfer position G, in other words, before the current sheet 5 to which an image is to be transferred reaches the transfer position G. More specifically, the CPU 31 controls the application circuit 40 to supply power to the transfer roller 25 for a predetermined time, for example, when the sheet 5 is not at the transfer position G. The CPU 31 acquires values of the transfer voltage V and the transfer current I before the sheet 5 reaches the transfer position G, based on the detection signal SV from the voltage detection circuit 44 and the detection signal SI from the current detection circuit 50 when the power is supplied to the transfer roller 25. The CPU 31 calculates a sheetless resistance value by dividing the value of the transfer voltage V by the value of the transfer current I.

Thereafter, the CPU 31 estimates a resistance value of the sheet 5, based on a detection signal SH from the humidity sensor 36 and the sheet information (S28). More specifically, for example, a resistance value of a sheet 5 when the humidity is at a reference humidity, the sheet type is a plain paper, and the sheet size is A4, is determined as an initial resistance value. With reference to the initial resistance value, the CPU 31 corrects the initial resistance value to a greater value as the humidity is higher and the sheet type has a greater thickness. The CPU 31 estimates the corrected resistance value as a resistance value of the sheet 5.

The CPU 31 calculates and acquires a transfer resistance value by combining the sheetless resistance value and the resistance value of the sheet 5 (S29). The CPU 31 stores the transfer resistance value, for example, in the RAM 33, after the transfer resistance value is acquired (S26). The CPU 31 proceeds to S3 of FIG. 4. Accordingly, processing burden on the CPU 31 may be reduced when an image is transferred to the sheet 5 because the resistance acquisition processing is performed when the image is not transferred to the sheet 5.

Figure 4:
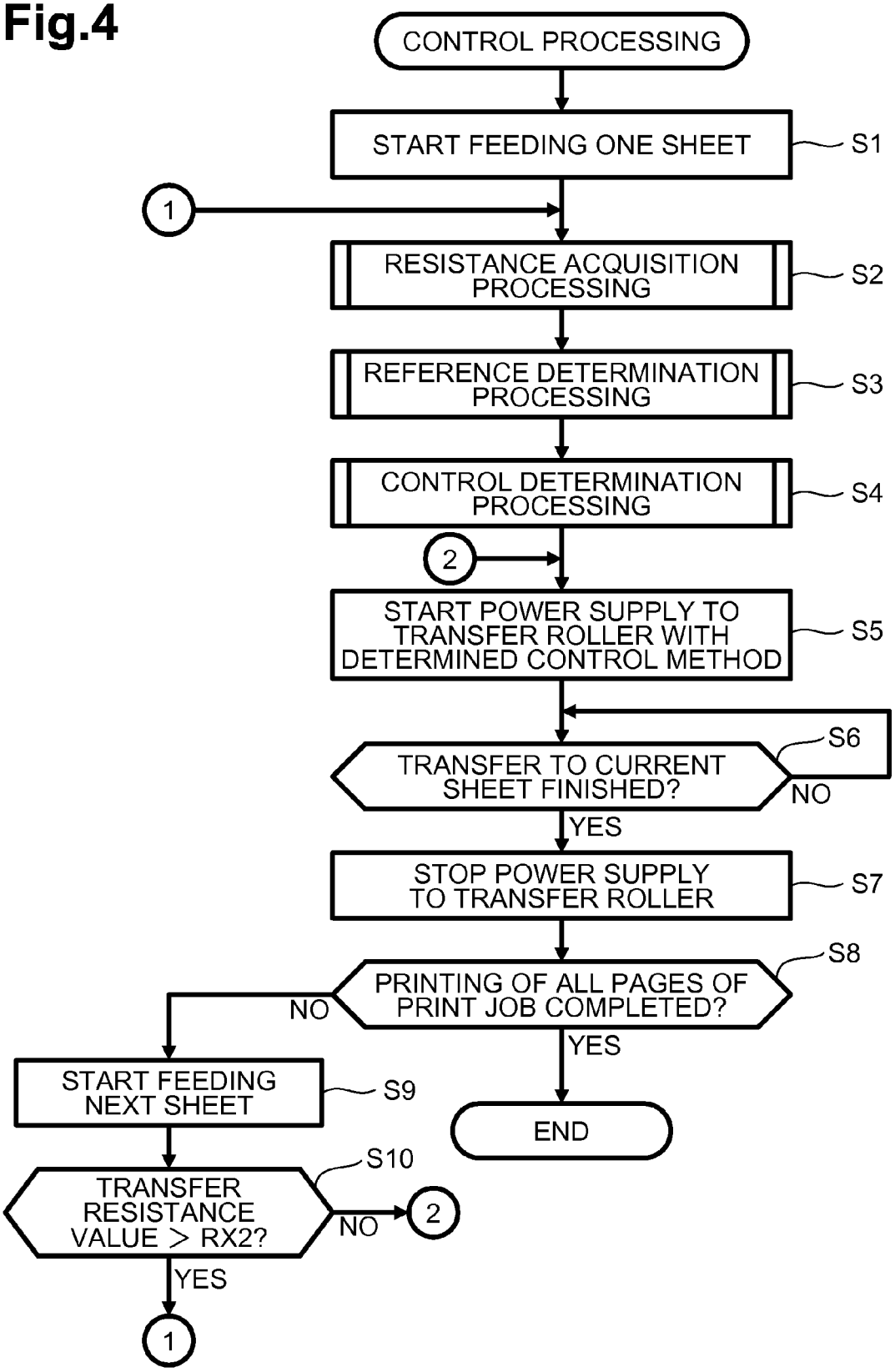
FIG. 4 is a flowchart depicting a control processing.
Figure 6:
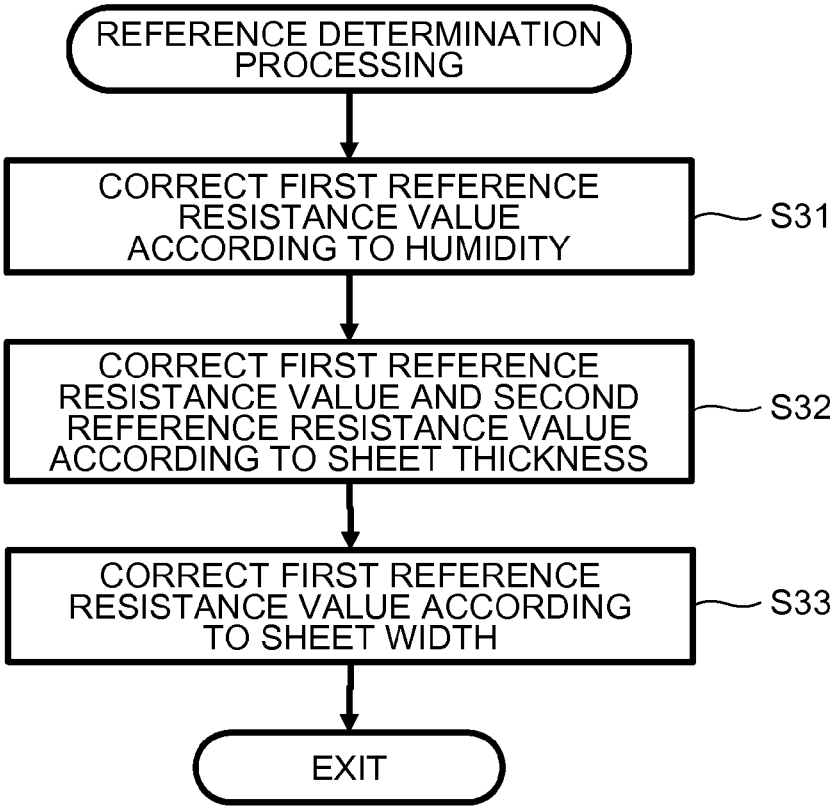
FIG. 6 is a flowchart depicting reference determination processing.

In S3 of FIG. 4, the CPU 31 performs reference determination processing depicted in FIG. 6. In the reference determination processing, the first reference resistance value RX1 and the second reference resistance value RX2 are determined according to transfer conditions. For example, values of the first reference resistance value RX1 and the second reference resistance value RX2 when the humidity is at the reference humidity, the sheet type is the plain paper, and the sheet size is A4, are determined as initial values.

As the humidity increases, proper transfer current values become smaller in the resistance range RA2. Therefore, the first reference resistance value RX1 may be increased to bring correlation between transfer resistance values and values of the transfer current I closer to the characteristic line Z (refer to FIG. 3). In S31 of FIG. 6, the CPU 31 corrects the first reference resistance value RX1 according to the humidity. More specifically, the CPU 31 detects the current humidity based on the detection signal SH from the humidity sensor 36. The CPU 31 corrects the first reference resistance value RX1 to a greater value as the detected humidity is greater as compared with the reference humidity.

As the sheet 5 becomes thicker, proper transfer current values become greater in the resistance range RA2 and the resistance range RA4. Therefore, the first reference resistance value RX1 and the second reference resistance value RX2 may be reduced to bring correlation between transfer resistance values and values of the transfer current I closer to the characteristic line Z (refer to FIG. 3). In S32 of FIG. 6, the CPU 31 corrects the first reference resistance value RX1 and the second reference resistance value RX2 according to the thickness of the sheet 5. More specifically, the CPU 31 corrects the first reference resistance value RX1 and the second reference resistance value RX2 to smaller values as the sheet 5 becomes thicker as compared with plain paper, based on the sheet information.

Further, as the width of the sheet 5 in a main scanning direction becomes narrower, proper transfer current values become greater in the resistance range RA2. Therefore, the first reference resistance value RX1 may be reduced to bring correlation between transfer resistance values and values of the transfer current I closer to the characteristic line Z (refer to FIG. 3). In S33 of FIG. 6, the CPU 31 corrects the first reference resistance value RX1 according to the sheet width. More specifically, the CPU 31 corrects the first reference resistance value RX1 to a smaller value as the sheet width becomes smaller as compared with the width of the A4-size sheet, based on the sheet information. Accordingly, deterioration of image quality due to changes in transfer conditions may be prevented or reduced. Steps S31 through S33 are an example of information acquisition processing and reference adjustment processing. The humidity, the sheet thickness, and the sheet width are an example of transfer condition information. The CPU 31 ends the reference adjustment processing and proceeds to S4 of FIG. 4.

Figure 7:
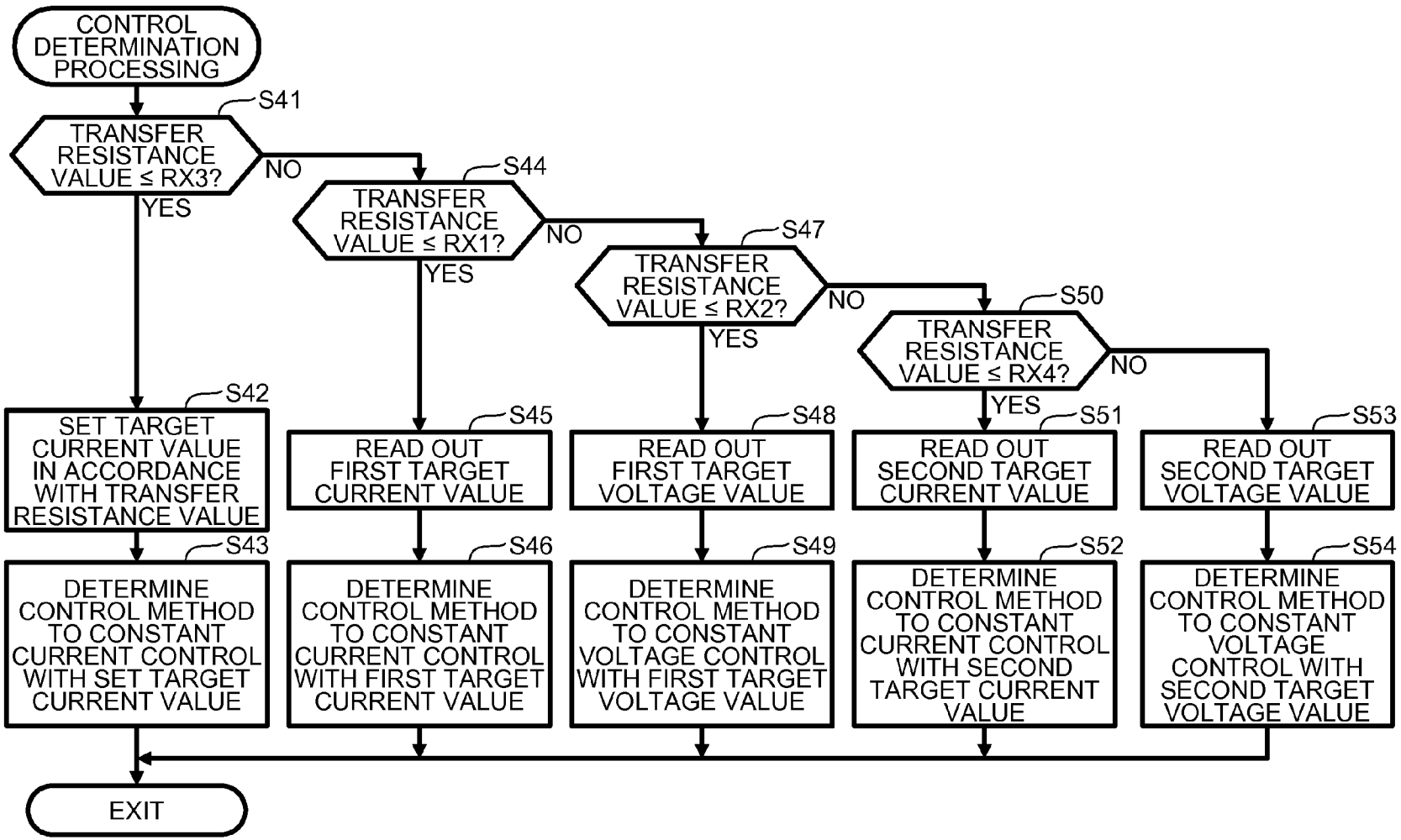
FIG. 7 is a flowchart depicting control determination processing.

In S4 of FIG. 4, the CPU 31 performs control determination processing depicted in FIG. 7. In the control determination processing, a control method for power supply to the transfer roller 25 is determined based on the transfer resistance value acquired in S2.

In S41 of FIG. 7, the CPU 31 determines whether the acquired transfer resistance value is less than or equal to the third reference resistance value RX3. The third reference resistance value RX3 is a value the same as or closer to a transfer resistance value at a boundary between the resistance range RA1 and the resistance range RA2 as depicted in FIG. 3. The third reference resistance value RX3 is a value lower than the first reference resistance value RX1, and is stored, for example, in the nonvolatile memory 34. In accordance with the determination of the CPU 31 that the acquired transfer resistance value is less than or equal to the third reference resistance value RX3 (S41: YES), the CPU 31 sets a target current value in accordance with the acquired transfer resistance value (S42).

More specifically, correlated data between transfer resistance values and target current values of the transfer current I in the resistance range RA1 is stored in the nonvolatile memory 34 in advance. The correlated data is derived by approximating the characteristic line Z. The correlated data may be in the form of a table or arithmetic expressions. The CPU 31 sets a target current value, based on the correlated data, to such a value whose absolute value is smaller, as the acquired transfer resistance value is smaller.

Then, the CPU 31 determines the constant current control, as a control method for power supply to the transfer roller 25, in which the transfer voltage V is controlled such that a value of the transfer current I obtained based on the detection signal SI from the current detection circuit 50 becomes a target current value set in S42 (S43). In a case where a transfer resistance value is relatively low, if the current control is performed every time with the same target current value regardless of the acquisition of transfer resistance values, poor transfer may occur due to excess or shortage of the transfer current I. In the illustrative embodiment, deterioration of image quality due to changes of transfer resistance values may be more reliably prevented or reduced with the control method determined as in S42 and S43, as compared with a case in which the current control is performed every time with the same target current value.

In S41 of FIG. 7, in accordance with the determination of the CPU 31 that the acquired transfer resistance value is not less than or equal to the third reference resistance value RX3 (S41: NO), the CPU 31 determines whether the acquired transfer resistance value is less than or equal to the first reference resistance value RX1 (S44). The first reference resistance value RX1 is determined in S3. In accordance with the determination of the CPU 31 that the acquired transfer resistance value is less than or equal to the first reference resistance value RX1 (S44: YES), the CPU 31 reads out a first target current value IM1, for example, from the nonvolatile memory 34 (S45). The first target current value IM1 is substantially the same as a proper transfer current value in the resistance range RA2 in the characteristic line Z of FIG. 3.

Thereafter, the CPU 31 determines the constant current control, as a control method for power supply to the transfer roller 25, in which the transfer voltage V is controlled such that a value of the transfer current I obtained based on the detection signal SI from the current detection circuit 50 becomes the first target current value IM1 (S46). Such current control is an example of a first current control. As described above, the resistance range RA2 is a range in which the above-described rate of change is relatively low as compared with, for example, the resistance range RA3. Therefore, even when transfer resistance values change in the resistance range RA2, proper transfer current values do not change significantly or greatly. Therefore, in such case, even when the current control is performed, possibilities of deterioration of image quality due to changes of transfer voltages V may be low. Poor transfer due to the shortage of the transfer current I may be prevented or reduced with the current control method determined as a control method.

In S44 of FIG. 7, in accordance with the determination of the CPU 31 that the acquired transfer resistance value is less than or equal to the first reference resistance value RX1 (S44: NO), the CPU 31 determines whether the acquired transfer resistance value is less than or equal to the second reference resistance value RX2 (S47). The second reference resistance value RX2 is greater than the first reference resistance value RX1 determined in S3. In accordance with the determination of the CPU 31 that the acquired transfer resistance value is less than or equal to the second reference resistance value RX2 (S47: YES), the CPU 31 reads out a first target voltage value VM1, for example, from the nonvolatile memory 34 (S48). The first target voltage value VM1 is a voltage value targeted for the voltage control to bring correlation between transfer resistance values and values of the transfer current I closer to the characteristic line Z, when the voltage control is performed in the resistance range RA3 of FIG. 3.

Then, the CPU 31 determines the constant voltage control, as a control method for power supply to the transfer roller 25, in which the transfer voltage V is controlled such that a value of the transfer voltage V obtained based on the detection signal SV from the voltage detection circuit 44 becomes the first target voltage value VM1 (S49). As described above, the rate of change is relatively high, in the resistance range RA3 as compared with, for example, the resistance range RA2. Therefore, as transfer resistance values change in the resistance range RA3, proper transfer current values change significantly or greatly. Therefore, in such a case, if the current control is performed, possibilities of deterioration of image quality may be high because transfer voltages V greatly change in association with great changes of transfer resistance values. Deterioration of image quality due to changes of transfer voltages V in association with changes of transfer resistance values may be prevented or reduced with the voltage control method determined as a control method.

In S47 of FIG. 7, in accordance with the determination of the CPU 31 that the acquired transfer resistance value is not equal to or less than the second reference resistance value RX2 (S47: NO), the CPU 31 determines whether the acquired transfer resistance value is less than or equal to a fourth reference resistance value RX4 (S50). The fourth reference resistance value RX4 is greater than the second reference resistance value RX2. In accordance with the determination of the CPU 31 that the acquired transfer resistance value is less than or equal to the fourth reference resistance value RX4. (S50: YES), the CPU 31 reads out a second target current value IM2, for example, from the nonvolatile memory 34 (S51). An absolute value of the second target current value IM2 is smaller than that of the first target current value IM1. The second target current value IM2 is substantially the same as a proper transfer current value in the resistance range RA4 in the characteristic line Z of FIG. 3.

Then, the CPU 31 determines the constant current control, as a control method for power supply to the transfer roller 25, in which the transfer voltage V is controlled such that a value of the transfer current I obtained based on the detection signal SI from the current detection circuit 50 becomes the second target current value IM2 (S52). As described above, the resistance range RA4 is a range in which the above-described rate of change is relatively low as compared with, for example, the resistance range RA3. Therefore, even when transfer resistance values change in the resistance range RA4, proper transfer current values do not change significantly or greatly. Therefore, in such a case, even when the current control is performed, possibilities of deterioration of image quality due to changes of transfer voltages V may be low. Poor transfer due to shortage of the transfer current I may be prevented or reduced with the current control method determined as a control method.

In S50 of FIG. 7, in accordance with the determination of the CPU 31 that the acquired transfer resistance value is not less than or equal to the fourth reference resistance value RX4 (S50: NO), the CPU 31 reads out a second target voltage value VM2, for example, from the nonvolatile memory 34 (S53). The second target voltage value VM2 is a limit voltage or an upper limit value of a prescribed range of voltages applicable to the transfer roller 25 or a voltage value slightly lower than the upper limit value.

Thereafter, the CPU 31 determines the constant voltage control, as a control method for power supply to the transfer roller 25, in which the transfer voltage V is controlled such that a value of the transfer voltage V obtained based on the detection signal SV from the voltage detection circuit 44 becomes the second target voltage value VM2 (S54). Thus, voltages that exceed the upper limit value of the prescribed range of voltages applicable to the transfer roller 25 may be prevented or reduced from being applied to the transfer roller 25. Steps S41, S44, S47, and S50 are an example of comparison processing and comparison processes. Steps S43, S46, S49, S52, and S54 are an example of control switching processing and control switching processes.

It is preferable that a current value (=VM1/RX2) obtained by dividing the first target voltage value VM1 by the second reference resistance value RX2 is the same as the second target current value IM2, and a current value (=VM1/RX1) obtained by dividing the first target voltage value VM1 by the first reference resistance value RX1 is the same as the first target current value IM1. However, it may be sometimes difficult to determine the first target voltage value VM1 to hold such relation. In this case, a difference ΔD2 between the current value (=VM1/RX2) and the second target current value IM2 may be less than or equal to a difference ΔD1 between the current value (=VM1/RX1) and the first target current value IM1. Accordingly, poor transfer due to shortage of the transfer current I may be prevented or reduced in a higher resistance range susceptible to the influence of the changes in transfer resistance values.

An absolute value of the current value (=VM1/RX2) is greater than or equal to an absolute value of the second target current value IM2. Accordingly, as compared with a case in which an absolute value of the current value (=VM1/RX2) is less than an absolute value of the second target current value IM2, poor transfer due to shortage of the transfer current I may be prevented or reduced in a higher resistance range susceptible to the influence of the changes in transfer resistance values.

As the CPU 31 determines a control method in the control determination processing, the CPU 31 controls the application circuit 40 to start power supply to the transfer roller 25 with the determined control method in S5 of FIG. 4. Thereafter, the CPU 31 determines whether a toner image transfer to the current sheet 5 is finished (S6). More specifically, the CPU 31 determines whether the trailing end of the current sheet 5 reaches the transfer position G, for example, based on a period of time that has elapsed since the pickup roller 7 feeds the sheet 5, or a period of time that has elapsed since the sensor (not detected) detects the sheet 5. When the CPU 31 determines that the transfer is not finished for the current sheet 5 (S6: NO), the CPU 31 waits. In accordance with the determination of the CPU 31 that the transfer is finished for the current sheet 5 (S6: YES), the CPU 31 controls the application circuit 40 to stop the power supply to the transfer roller 25 (S7). The CPU 31 proceeds to S8.

In S8, the CPU 31 determines whether printing of all pages of the print job completes. In accordance with the determination of the CPU 31 that printing of all pages of the print job completes (S8: YES), the CPU 31 ends the control processing. In accordance with the determination of the CPU 31 that printing of all pages of the print job has not yet completed (S8: NO), the CPU 31 controls the feeder unit 3 to start feeding a next sheet 5 to be subjected to an image transfer (S9), and proceeds to S10.

In S10, the CPU 31 determines whether the acquired transfer resistance value is greater than or equal to the second reference resistance value RX2. In other words, the CPU 31 determines whether the acquired transfer resistance value falls within a higher resistance range.

In accordance with the determination of the CPU 31 that the acquired transfer resistance value is greater than the second reference resistance value RX2 or falls within the higher resistance range (S10: YES), the CPU 31 proceeds to S2. The CPU 31 determines a control method for power supply to the transfer roller 25 for the next sheet 5, based on steps S2-S4, and then proceeds to S5.

In accordance with the determination of the CPU 31 that the acquired transfer resistance value is not greater than the second reference resistance value RX2, or falls within a lower resistance range (S10: NO), the CPU 31 proceeds to S5 without performing steps S2-S4. As described above, when the acquired transfer resistance value exceeds the second reference resistance value RX2, the frequency of performing the resistance acquisition processing increases as compared with a case in which the acquired transfer resistance value is less than or equal to the first reference resistance value RX1. Accordingly, poor transfer may be prevented or reduced in a higher resistance range susceptible to the influence of the changes in transfer resistance values. Step S10 is an example of time change processing.

The CPU 31 performs, for example, the resistance acquisition processing, once for one sheet 5 at most. Therefore, as compared with a case in which the CPU 31 performs, for example, the resistance acquisition processing, more than once for one sheet 5, processing burden on the CPU 31 may be reduced. Deterioration in transfer quality due to control methods switched during transfer on one sheet 5 may be prevented or reduced.

According to the illustrative embodiment, as a transfer resistance value exceeds the third reference resistance value RX3 and is less than or equal to the first reference resistance value RX1, the printer 1 performs the constant current control such that a value of the transfer current I becomes the first target current value IM1. Thus, poor transfer due to an excessive transfer current I may be prevented or reduced. The printer 1 performs the constant voltage control such that a value of the transfer voltage V becomes the first target voltage value VM1 as a transfer resistance value exceeds the first reference resistance value RX1, and is less than or equal to the second reference resistance value RX2. Accordingly, as compared with a case in which the current control is performed, deterioration of image quality due to changes of transfer voltages V in association with changes of transfer resistance values may be prevented or reduced. Further, the printer 1 performs the constant current control such that a value of the transfer current I becomes the second target current value IM2 whose absolute value is smaller than that of the first target current value IM1 as a transfer resistance value exceeds the second reference resistance value RX2 and is less than or equal to the fourth reference resistance value RX4. Accordingly, poor transfer due to shortage of the transfer current I may be prevented or reduced.

The printer 1 according to the illustrative embodiment is compared with a printer configured to perform real time feedback control. In the real time feedback control, a transfer resistance value is sequentially measured. A proper transfer current value corresponding to the measured value is determined based on data of the characteristic line Z. Power supply to the transfer roller 25 is controlled such that a value of the transfer current I becomes a proper transfer current value.

In the printer configured to perform the real time feedback control, if processing from measurement of a transfer resistance value to determination of a proper transfer current value, is not repeatedly performed at relatively short control time intervals, control in accordance with the characteristic line Z might not be performed. For example, when high-speed printing (e.g., 100 ppm) is performed, a so-called follow-up delay, in which control of power supply to the transfer roller 25 delays with respect to changes of transfer resistance values, may occur, especially, in the resistance range RA3. Further, for example, even when transfer resistance values fluctuate, values of the transfer current I are not changed except every control time interval.

In the printer 1 according to the illustrative embodiment, control time interval does not have to be more reduced than that of the real time feedback control. As described above, power supply control closer to the characteristic line Z may be performed with the reduced number of processing from a measurement of a transfer resistance value to the determination of a proper transfer current value as compared with the real time feedback control. Especially, even when the number of measurements of transfer resistance values is reduced in the resistance range RA3, power supply control closer to the characteristic line Z may be realized by the voltage control.

While the disclosure has been described in detail referring to the specific embodiment thereof, this is merely an example, and various changes, arrangements and modifications may be applied therein without departing from the spirit and scope of the disclosure.

For example, the image forming apparatus is not limited to a printer but may be a multifunction device, a copier, or a facsimile machine, each including a plurality of functions, e.g., a printing function and a reading function. The image forming apparatus is not limited to a laser printer but may be an apparatus using other electrophotographic methods, e.g., a LED printer. Further, the image forming apparatus may be configured to perform printing in colors.

The image forming apparatus may have a structure using an intermediate transfer method. In such a structure, a photosensitive member for primary transfer and an intermediate transfer belt for secondary transfer may be an example of an image carrier. A transfer roller opposing the photosensitive member with the intermediate transfer belt interposed therebetween and a transfer roller opposing the intermediate transfer belt with a sheet feeding path therebetween may be an example of a transfer member. The transfer member is not limited to a roller member, but may be, for example, a pad.

The image forming apparatus is configured to form an image with positive-polarity toner. In another embodiment, the image forming apparatus may be configured to form an image with negative-polarity toner. In this structure, the polarity of a transfer voltage may be positive.

The controller performs the respective processing depicted in FIGS. 4-7 with the single CPU 31. In another embodiment, the controller may perform the respective processing depicted in FIGS. 4-7, with a plurality of CPUs. Alternatively, the controller may perform the respective processing depicted in FIGS. 4-7, with specific hardware circuitry, e.g., the ASIC 35. Alternatively, the controller may perform the respective processing depicted in FIGS. 4-7, with a combination of a CPU and hardware circuitry.

In the resistance acquisition processing in S2 of FIG. 4, the CPU 31 may correct a reference transfer resistance value corresponding to a reference temperature and a reference humidity, based on an amount of change from the reference temperature and the reference humidity obtained using a temperature sensor and a humidity sensor. The corrected value may be used as a current transfer resistance value.

When the CPU 31 determines that the acquisition condition is not satisfied in S21 of FIG. 5, the acquired transfer resistance value for one of two or more preceding sheets 5 may be and used in S22 of FIG. 5.

In S28 of FIG. 5, the resistance value of the sheet 5 may be estimated based on the temperature. In another embodiment, the CPU 31 may read out a fixed resistance value, for example, from the nonvolatile memory 34, without estimating the resistance value of the sheet 5. Further, the CPU 31 may utilize the last estimation result if the type of the sheet 5 is not changed between the last and current sheets 5.

In the reference determination processing in S3 of FIG. 4, the CPU 31 may adjust either one of the first reference resistance value RX1 and the second reference resistance value RX2, or may adjust at least one of the third reference resistance value RX3 and the fourth reference resistance value RX4 according to transfer conditions. In the reference determination processing, the CPU 31 may adjust, for example, the first reference resistance value RX1, according to the temperatures.

The CPU 31 may change the first target current value IM1 or the second target current value IM2, according to transfer conditions.

In S42 of FIG. 7, the CPU 31 may set a target current value to such a value corresponding to the humidity sensed by the humidity sensor 36 or the temperature sensed by a temperature sensor (not depicted).

The CPU 31 may perform the resistance acquisition processing, the comparison processing and the control switching processing once for one print job, or once for a plurality of the sheets 5, instead of performing for every one sheet 1.

One or more aspects of the disclosure may be accomplished in various manners, for example, using image forming apparatus, methods for controlling power supply to transfer members, computer-readable programs for implementing the methods or apparatus functions, or non-volatile recording media recording the computer-readable programs.

The disclosure relates to a technique of preventing or reducing poor transfer with a structure different from that of a known image forming apparatus.

According to one or more aspects of the disclosure, poor transfer may be prevented or reduced with a structure different from a known structure.

What is claimed is:

1. An image forming apparatus comprising:

an image carrier;

a transfer member;

an application circuit; and a controller configured to perform steps comprising:

acquiring a transfer resistance value, the transfer resistance value being a value of electric resistance between the image carrier and the transfer member;

determining whether the acquired transfer resistance value is less than or equal to a first reference resistance value;

controlling the application circuit, in response to determining that the acquired transfer resistance value is less than or equal to the first reference resistance value, to perform a first current control process to cause a value of a transfer current passing through the transfer member to become a first target current value;

determining, in response to determining that the acquired transfer resistance value is not less than or equal to the first reference resistance value, whether the acquired transfer resistance value is less than or equal to a second reference resistance value, the second reference resistance value being greater than the first reference resistance value;

controlling the application circuit, in response to determining that the acquired transfer resistance value is less than or equal to the second reference resistance value, to perform a voltage control process to cause a value of a transfer voltage applied to the transfer member to become a target voltage value; and controlling the application circuit, in response to determining that the acquired transfer resistance value is not less than or equal to the second reference resistance value, to perform a second current control process to cause a value of the transfer current to become a second target current value, an absolute value of the second target current value being smaller than an absolute value of the first target current value, wherein a difference between a current value obtained by dividing the target voltage value by the second reference resistance value and the second target current value is less than or equal to a difference between a current value obtained by dividing the target voltage value by the first reference resistance value and the first target current value.

2. The image forming apparatus according to claim 1 wherein the controller is further configured to:

acquiring transfer condition information including at least one of temperature in the image forming apparatus, humidity in the image forming apparatus and a type of a sheet to which an image is transferred from the transfer member; and adjusting at least one of the first reference resistance and the second reference resistance in accordance with the acquired transfer condition information.

3. The image forming apparatus according to claim 1, wherein the controller is further configured to:

determining whether the acquired transfer resistance value is less than or equal to a third reference resistance value, the third reference resistance value being a value less than the first reference resistance value; and controlling the application circuit, in response to determining that the acquired transfer resistance value is less than or equal to the third reference resistance value, to set a target current value to such a value whose absolute value becomes smaller as the acquired transfer resistance value becomes smaller.

4. The image forming apparatus according to claim 1, further comprising:

a sheet feeder, wherein the controller is further configured to:

acquiring the transfer resistance value once for one sheet;

determining whether the acquired transfer resistance value is less than or equal to the first reference resistance value once for one sheet;

controlling the application circuit, in response to determining that the acquired transfer resistance value is less than or equal to the first reference resistance value, to perform the first current control process once for one sheet;

determining, in response to determining that the acquired transfer resistance value is not less than or equal to the first reference resistance value, whether the acquired transfer resistance value is less than or equal to the second reference resistance value once for one sheet;

controlling the application circuit, in response to determining that the acquired transfer resistance value is less than or equal to the second reference resistance value, to perform the voltage control process once for one sheet; and controlling the application circuit, in response to determining that the acquired transfer resistance value is not less than or equal to the second reference resistance value, to perform the second current control process once for one sheet.

5. The image forming apparatus according to claim 4, wherein the controller is further configured to perform steps comprising:

determining whether a leading end of a sheet reaches a transfer position, the transfer position being a position at which the image carrier and the transfer member oppose each other; and acquiring the transfer resistance value in response to determining that the leading end of the sheet reaches the transfer position.

6. The image forming apparatus according to claim 1, further comprising:

a sheet feeder, wherein the controller is further configured to perform steps comprising:

determining whether a sheet reaches a transfer position, the transfer position being a position at which the image carrier and the transfer member oppose each other;

acquiring the transfer resistance value in response to determining that a leading end of the sheet reaches the transfer position;

determining whether the acquired transfer resistance value is less than or equal to the first reference resistance value;

controlling the application circuit, in response to determining that the acquired transfer resistance value is less than or equal to the first reference resistance value, to perform the first current control process for another sheet subsequent to the sheet;

determining, in response to determining that the acquired transfer resistance value is not less than or equal to the first reference resistance value, whether the acquired transfer resistance value is less than or equal to the second reference resistance value;

controlling the application circuit, in response to determining that the acquired transfer resistance value is less than or equal to the second reference resistance value, to perform the voltage control process for the other sheet subsequent to the sheet; and controlling the application circuit, in response to determining that the acquired transfer resistance value is not less than or equal to the second reference resistance value, to perform the second current control process for the other sheet subsequent to the sheet.

7. The image forming apparatus according to claim 1, further comprising:

a sheet feeder, wherein the controller is further configured to perform steps comprising:

acquiring a sheetless transfer resistance value before a sheet reaches a transfer position, the transfer position being a position at which the image carrier and the transfer member oppose each other;

acquiring a resistance value of the sheet; and acquiring the transfer resistance value in accordance with the acquired sheetless transfer resistance value and the resistance value of the sheet.

8. The image forming apparatus according to claim 1, wherein the controller is further configured to perform steps comprising:

determining whether the acquired transfer resistance value is greater than a third reference resistance value, the third reference resistance value being a value greater than the second reference resistance value; and controlling the application circuit, in response to determining that the acquired transfer resistance value is greater than the third reference resistance value, to perform a voltage control process to cause a value of the transfer voltage to become less than or equal to an upper limit value of a range of voltages applicable to the transfer member.

9. The image forming apparatus according to claim 1, wherein the controller comprises:

a processor; and a memory storing processor-executable instructions that when executed by the processor perform the steps.

10. The image forming apparatus according to claim 1, wherein the controller is further configured to perform steps comprising:

acquiring, in response to determining that the acquired transfer resistance value is not less than or equal to the second reference resistance value, a second transfer resistance value, the second transfer resistance value being a value of electric resistance between the image carrier and the transfer member; and controlling, in response to determining that the acquired transfer resistance value is less than or equal to the second reference resistance value, the application circuit to start power supply to the transfer member without acquiring the second transfer resistance value, and wherein an absolute value of a current value obtained by dividing the target voltage value by the second reference resistance value is greater than or equal to an absolute value of the second target current value.

11. An image forming apparatus comprising:

an image carrier;

a transfer member;

an application circuit; and a controller configured to perform steps comprising:

acquiring a transfer resistance value, the transfer resistance value being a value of electric resistance between the image carrier and the transfer member;

determining whether the acquired transfer resistance value is less than or equal to a first reference resistance value;

controlling the application circuit, in response to determining that the acquired transfer resistance value is less than or equal to the first reference resistance value, to perform a first current control process to cause a value of a transfer current passing through the transfer member to become a first target current value;

determining, in response to determining that the acquired transfer resistance value is not less than or equal to the first reference resistance value, whether the acquired transfer resistance value is less than or equal to a second reference resistance value, the second reference resistance value being greater than the first reference resistance value;

controlling the application circuit, in response to determining that the acquired transfer resistance value is less than or equal to the second reference resistance value, to perform a voltage control process to cause a value of a transfer voltage applied to the transfer member to become a target voltage value; and controlling the application circuit, in response to determining that the acquired transfer resistance value is not less than or equal to the second reference resistance value, to perform a second current control process to cause a value of the transfer current to become a second target current value, an absolute value of the second target current value being smaller than an absolute value of the first target current value, wherein an absolute value of a current value obtained by dividing the target voltage value by the second reference resistance value is greater than or equal to an absolute value of the second target current value.

12. The image forming apparatus according to claim 11, further comprising:

a sheet feeder, wherein the controller is further configured to:

acquiring the transfer resistance value once for one sheet;

determining whether the acquired transfer resistance value is less than or equal to the first reference resistance value once for one sheet;

controlling the application circuit, in response to determining that the acquired transfer resistance value is less than or equal to the first reference resistance value, to perform the first current control process once for one sheet;

determining, in response to determining that the acquired transfer resistance value is not less than or equal to the first reference resistance value, whether the acquired transfer resistance value is less than or equal to the second reference resistance value once for one sheet;

controlling the application circuit, in response to determining that the acquired transfer resistance value is less than or equal to the second reference resistance value, to perform the voltage control process once for one sheet; and controlling the application circuit, in response to determining that the acquired transfer resistance value is not less than or equal to the second reference resistance value, to perform the second current control process once for one sheet.

13. The image forming apparatus according to claim 12, wherein the controller is further configured to perform steps comprising:

determining whether a leading end of a sheet reaches a transfer position, the transfer position being a position at which the image carrier and the transfer member oppose each other; and acquiring the transfer resistance value in response to determining that the leading end of the sheet reaches the transfer position.

14. The image forming apparatus according to claim 11, further comprising:

a sheet feeder, wherein the controller is further configured to perform steps comprising:

determining whether a sheet reaches a transfer position, the transfer position being a position at which the image carrier and the transfer member oppose each other;

acquiring the transfer resistance value in response to determining that a leading end of the sheet reaches the transfer position;

determining whether the acquired transfer resistance value is less than or equal to the first reference resistance value;

controlling the application circuit, in response to determining that the acquired transfer resistance value is less than or equal to the first reference resistance value, to perform the first current control process for another sheet subsequent to the sheet;

determining, in response to determining that the acquired transfer resistance value is not less than or equal to the first reference resistance value, whether the acquired transfer resistance value is less than or equal to the second reference resistance value;

controlling the application circuit, in response to determining that the acquired transfer resistance value is less than or equal to the second reference resistance value, to perform the voltage control process for the other sheet subsequent to the sheet; and controlling the application circuit, in response to determining that the acquired transfer resistance value is not less than or equal to the second reference resistance value, to perform the second current control process for the other sheet subsequent to the sheet.

15. The image forming apparatus according to claim 11, further comprising:

a sheet feeder, wherein the controller is further configured to perform steps comprising:

acquiring a sheetless transfer resistance value before a sheet reaches a transfer position, the transfer position being a position at which the image carrier and the transfer member oppose each other;

acquiring a resistance value of the sheet; and acquiring the transfer resistance value in accordance with the acquired sheetless transfer resistance value and the resistance value of the sheet.

16. An image forming apparatus comprising:

an image carrier;

a transfer member;

an application circuit; and a controller configured to perform steps comprising:

acquiring a transfer resistance value, the transfer resistance value being a value of electric resistance between the image carrier and the transfer member;

determining whether the acquired transfer resistance value is less than or equal to a first reference resistance value;

controlling the application circuit, in response to determining that the acquired transfer resistance value is less than or equal to the first reference resistance value, to perform a first current control process to cause a value of a transfer current passing through the transfer member to become a first target current value;

determining, in response to determining that the acquired transfer resistance value is not less than or equal to the first reference resistance value, whether the acquired transfer resistance value is less than or equal to a second reference resistance value, the second reference resistance value being greater than the first reference resistance value;

controlling the application circuit, in response to determining that the acquired transfer resistance value is less than or equal to the second reference resistance value, to perform a voltage control process to cause a value of a transfer voltage applied to the transfer member to become a target voltage value;

controlling the application circuit, in response to determining that the acquired transfer resistance value is not less than or equal to the second reference resistance value, to perform a second current control process to cause a value of the transfer current to become a second target current value, an absolute value of the second target current value being smaller than an absolute value of the first target current value;

acquiring, in response to determining that the acquired transfer resistance value is not less than or equal to the second reference resistance value, a second transfer resistance value, the second transfer resistance value being a value of electric resistance between the image carrier and the transfer member; and controlling, in response to determining that the acquired transfer resistance value is less than or equal to the second reference resistance value, the application circuit to start power supply to the transfer member without acquiring the second transfer resistance value.

17. The image forming apparatus according to claim 16, further comprising:

a sheet feeder, wherein the controller is further configured to:

acquiring the transfer resistance value once for one sheet;

determining whether the acquired transfer resistance value is less than or equal to the first reference resistance value once for one sheet;

controlling the application circuit, in response to determining that the acquired transfer resistance value is less than or equal to the first reference resistance value, to perform the first current control process once for one sheet;

determining, in response to determining that the acquired transfer resistance value is not less than or equal to the first reference resistance value, whether the acquired transfer resistance value is less than or equal to the second reference resistance value once for one sheet;

controlling the application circuit, in response to determining that the acquired transfer resistance value is less than or equal to the second reference resistance value, to perform the voltage control process once for one sheet; and controlling the application circuit, in response to determining that the acquired transfer resistance value is not less than or equal to the second reference resistance value, to perform the second current control process once for one sheet.

18. The image forming apparatus according to claim 17, wherein the controller is further configured to perform steps comprising:

determining whether a leading end of a sheet reaches a transfer position, the transfer position being a position at which the image carrier and the transfer member oppose each other; and acquiring the transfer resistance value in response to determining that the leading end of the sheet reaches the transfer position.

19. The image forming apparatus according to claim 16, further comprising:

a sheet feeder, wherein the controller is further configured to perform steps comprising:

determining whether a sheet reaches a transfer position, the transfer position being a position at which the image carrier and the transfer member oppose each other;

acquiring the transfer resistance value in response to determining that a leading end of the sheet reaches the transfer position;

determining whether the acquired transfer resistance value is less than or equal to the first reference resistance value;

controlling the application circuit, in response to determining that the acquired transfer resistance value is less than or equal to the first reference resistance value, to perform the first current control process for another sheet subsequent to the sheet;

determining, in response to determining that the acquired transfer resistance value is not less than or equal to the first reference resistance value, whether the acquired transfer resistance value is less than or equal to the second reference resistance value;

controlling the application circuit, in response to determining that the acquired transfer resistance value is less than or equal to the second reference resistance value, to perform the voltage control process for the other sheet subsequent to the sheet; and controlling the application circuit, in response to determining that the acquired transfer resistance value is not less than or equal to the second reference resistance value, to perform the second current control process for the other sheet subsequent to the sheet.

20. The image forming apparatus according to claim 16, further comprising:

a sheet feeder, wherein the controller is further configured to perform steps comprising:

acquiring a sheetless transfer resistance value before a sheet reaches a transfer position, the transfer position being a position at which the image carrier and the transfer member oppose each other;

acquiring a resistance value of the sheet; and acquiring the transfer resistance value in accordance with the acquired sheetless transfer resistance value and the resistance value of the sheet.

* * * * *